United States Patent [19]

Klose

[11] Patent Number: 4,706,892

[45] Date of Patent: Nov. 17, 1987

[54] METHOD AND SYSTEM FOR THE PREPARATION OF A HIGHLY CONCENTRATED MINERAL SLURRY HAVING SUBSTANTIALLY CONSTANT IDENTIFYING CHARACTERISTICS

[75] Inventor: Reinhard Klose, Cramme, Fed. Rep. of Germany

[73] Assignee: Salzgitter Industriebau GmbH, Salzgitter, Fed. Rep. of Germany

[21] Appl. No.: 840,445

[22] Filed: Mar. 17, 1986

[30] Foreign Application Priority Data

Jul. 30, 1985 [EP] European Pat. Off. ..... 85109553.9

[51] Int. Cl.[4] ..... B02C 23/18

[52] U.S. Cl. ..... 241/16; 241/21; 241/34; 241/36

[58] Field of Search ..... 44/51; 406/19; 48/202, 48/201, 200; 366/17, 21; 110/347; 241/21, 30, 36, 34, 24, 33, 101 D, 16

[56] References Cited

U.S. PATENT DOCUMENTS

| | | | |
|---|---|---|---|
| 2,824,701 | 2/1958 | Vester et al. | 241/21 |
| 3,255,975 | 6/1966 | Malin et al. | 241/34 X |
| 3,351,293 | 11/1967 | Meisel | 241/21 |
| 4,282,006 | 8/1981 | Funk | 44/51 |
| 4,397,561 | 8/1983 | Strong et al. | 366/21 |
| 4,416,666 | 11/1983 | Funk | 44/51 |
| 4,432,674 | 2/1984 | Klose et al. | 406/19 |
| 4,441,887 | 4/1984 | Funk | 44/51 |
| 4,468,232 | 8/1984 | Funk | 44/51 |
| 4,477,259 | 10/1984 | Funk | 44/51 |
| 4,477,260 | 10/1984 | Funk | 44/51 |
| 4,479,806 | 10/1984 | Funk | 44/51 |
| 4,481,015 | 11/1984 | Lusch et al. | 241/30 X |
| 4,494,959 | 1/1985 | Funk | 44/51 |
| 4,501,205 | 2/1985 | Funk | 110/347 |
| 4,526,584 | 7/1985 | Funk | 44/51 |

FOREIGN PATENT DOCUMENTS

| | | | |
|---|---|---|---|
| 2019696 | 11/1971 | Fed. Rep. of Germany . | |
| 2929430 | 10/1981 | Fed. Rep. of Germany . | |
| 1238407 | 7/1971 | United Kingdom . | |
| 1238408 | 7/1971 | United Kingdom . | |
| 1475474 | 6/1977 | United Kingdom . | |
| 1011262 | 4/1983 | U.S.S.R. | 241/36 |

OTHER PUBLICATIONS

"Particle Size Measurement" by Terence Allen, Ph.D., published by Chapman and Hall Ltd, London, pp. 98–99.

"Betriebsanleitung für Rotovisco RV12" by Haake, Handbook describing Viscosity Meter Made by Haake Mess-Technik GmbH u. Co.

"Bedienungs-Handbuch Helos 12LA"—Sympatec GmbH, Handbook describing Particle Size Analyzer, made by Sympatec GmbH.

*Primary Examiner*—Mark Rosenbaum

*Attorney, Agent, or Firm*—Nils H. Ljungman

[57] ABSTRACT

A method and a system for preparation of a highly concentrated and fine-grained suspension such as a coal-water slurry comprises feeding of coarse solid matter by a metering conveyor type weigher and of a carrier liquid and additives into a ball mill, in which the solid matter is ground and the suspension is formed. The particle size and distribution are analyzed and the viscosity is determined. The speed of the ball mill and the amounts of the carrier liquid and additives are adjusted during the continuous preparation process so that a suspension with constant characteristic features such as particle size and distribution, content of solid matter and viscosity is supplied into a pipeline.

8 Claims, 3 Drawing Figures

□ analyzed values

——— theoretical RRSB-distribution

— — — distribution according to Alfred formula for n=0,2 and n=0,7

METHOD AND SYSTEM FOR THE PREPARATION OF A HIGHLY CONCENTRATED MINERAL SLURRY HAVING SUBSTANTIALLY CONSTANT IDENTIFYING CHARACTERISTICS

BACKGROUND OF THE INVENTION

The invention relates to the hydraulic transport of solid matter and, in particular, to a method for preparation of a suspension such as a coal-water slurry having constant characteristic features from basic materials of variable properties, and to a system to be used herewith.

The suspension comprises fine-grained coal or a fine-grained mineral and a liquid carrier such as water. The suspension enables the solid matter to be conveyed, stored in large vessels and put to final use.

The coarse solid matter to be milled and included in the suspension has a variable moisture content and other variable properties. The actual hardness of the raw material can, for example, influence the fineness of grain achieved by a comminuting process. Also the liquid carrier can have some influence on the features of the suspension if, for example, the temperature or the salt content varies. Usually some liquid additives are added to the suspension. The additives affect the features of the suspension. The additives are surfactants, tensides, defoaming agents, stabilizers and/or biocides and the like.

For pumping, conveying and later applicating certain constant features of the suspension are required such as a high proportion of the solid matter, a certain range of fineness of grain and the viscosity of the suspension.

DESCRIPTION OF PRIOR ART

In my U.S. Pat. No. 4,432,674 (corresponding to German Pat. No. 29 29 430) a method and device are described for rapid determination of the consistency of a slurry in order to precisely monitor and control the conveyed stream. With this device and method the solid matter content is analyzed for shape and size of the solid particles and the amount and/or feed pressure of the carrier liquid. A pressure control and an adjustment of solid matter to liquid proportion is possible. However, neither the fineness of the solid particles nor the viscosity of the suspension are influenced, and no consideration is given to the additives.

In the U.S. Pat. No. 4,282,006, granted to J. A. Funk, a coal-water slurry and methods for making it are described. The slurry contains at least 60 weight percent of coal, dry basis. The particle size is in the range from 1.18 mm to 0.0005 mm and at least 5 wgt. % are of colloidal size. It is intended to have a particle size distribution according to a so-called "Alfred sonsist formula" which is expected to result in a high content of fine solid particles in the slurry and in a non-undulating size distribution permitting a closer packing. Electrolyte and/or dispersing agents are added to provide counterions in the carrier water. The slurry has yield pseudoplastic rheological properties. For preparing the slurry crushed coal is milled with a certain amount of the water in a first ball mill, and perhaps after further treatment, fed into at least one second ball mill into which deflocculant material and water are added. Fractions, e.g. from the first and the second mills are blended in a tank so that an Alfred formula coal-water slurry is achieved. The process does not run continuously. The conditions to carry out the process, and the sort and amount of agents are determined, which depend on the origin of the coal. Because of the batchwise production and blending no continuous adjustment or control of the conditions is required.

SUMMARY OF THE INVENTION

It is an object of the present invention to improve the preparation of a highly concentrated suspension of fine-grained particles in order to achieve a suspension with certain features even if the properties of the basic materials are variable.

The invention relates to a continuous process for preparing a suspension or a slurry containing 60 wgt.% or more finely divided solid particles whereby grinding is effected in one ball mill which results in a particle size distribution according to Weilbull or RRSB and whereby the process is controlled and influencing factors are adjusted so that the essential features of the continuously produced slurry are maintained constant. All carrier water and selected additives are fed at the beginning of the milling process. The speed of the ball mill is adjustable. The produced suspension is preferably a dilatant or Bingham liquid with respect to its rheological properties. The viscosity is at a set value which is smaller than 2 Pa.s (2 $N.s/m^2$) and preferably between 0.2 and 1.2 Pa.s at a temperature of 20 degree C. and a shear rate of $100^{-s}$.

It was discovered that the viscosity depends on the concentration of an additive and on the kind of the additive. Also the rheological properties are influenced by the additives and the method of preparing the suspension. Therefore, by selecting the kind and concentration of the additives, the viscosity of a continuously prepared and supplied suspension can be maintained at an index value if for any reason it should begin to deviate. Reasons for a deviation can be variations in the quality of the coal but also in the particle size distribution and other factors.

According to the present invention coarse parts of the solid matter, a liquid carrier, and additives are subjected to a comminuting and mixing process, in which the solid matter is ground and the suspension is formed. The features of the prepared suspension are examined and, if necessary, the composition of the basic materials and/or the comminuting and mixing process are adjusted to maintain certain reference value of the suspension. Preferably, the moisture content of the solid matter is determined before mixing, and the amount of the liquid carrier is adjusted accordingly.

If, for example, coal is used as solid matter the raw material is crushed to a maximum grain size of 6 mm, ideally of 4 mm, and in the comminuting and mixing process further ground in one step to a maximum grain size of 0.2 mm, whereby a RRSB particle size distribution is achived in which at least two thirds of the solid matter have a maximum grain size of 0.1 mm. It was found that a suspension comprising a certain amount in the range of 65 to 75 wgt. %, dry basis, of such fine-grained particles can be pumped and conveyed in a pipeline over long distances.

Usually, the total amount of additives in such a suspension is up to about 2%. It was found that by selecting appropriate, generally available surfactants, the total amount may be increased to more than 2% without any disadvantages in respect of e.g. the stabilizing effects. The effect of different possible agents and their concentration in the suspension on the viscosity varies broadly. By selecting the kind, the amount, and/or the mixture of the additives particularly the surfactants the viscosity of the suspension is maintained constant, if it deviates from a set value, for example, because of varying the grain size of the solid particles or the carrier substance, while the suspension is continuously prepared and delivered. In addition to the adjustment of the composition of the basic materials including the selection of the additives which preferably are added as liquid solution, the comminuting process may be adjusted. In this way there are two control operations which are superimposed to prepare a suspension having constant characteristic features.

As a mixing and comminuting device a ball mill is preferred, which in subsequent sections contains balls, the diameters of which decrease according to the degree of comminution of the solid matter. By amending the speed of the ball mill while the throughput remains constant, the degree of final size reduction and the particle size distribution are adjusted.

The formed suspension is examined in respect to the viscosity and to the grain size distribution. The examination is carried out automatically by appropriate well-known devices, and the preparation of the suspension is controlled by a computer, the program of which controls the speed of the ball mill, the composition of the basic materials and the amount and composition of the additives.

DESCRIPTION OF A PREFERRED EMBODIMENT

In the preferred embodiment a suspension is prepared which comprises fine-grained coal, water as the carrier substance, and additives such as surfactants and defoamers. For conveying storing and, finally, for the combustion of the suspension it is desired that the viscosity and a coal content of 70% remains constant.

Figure 1:
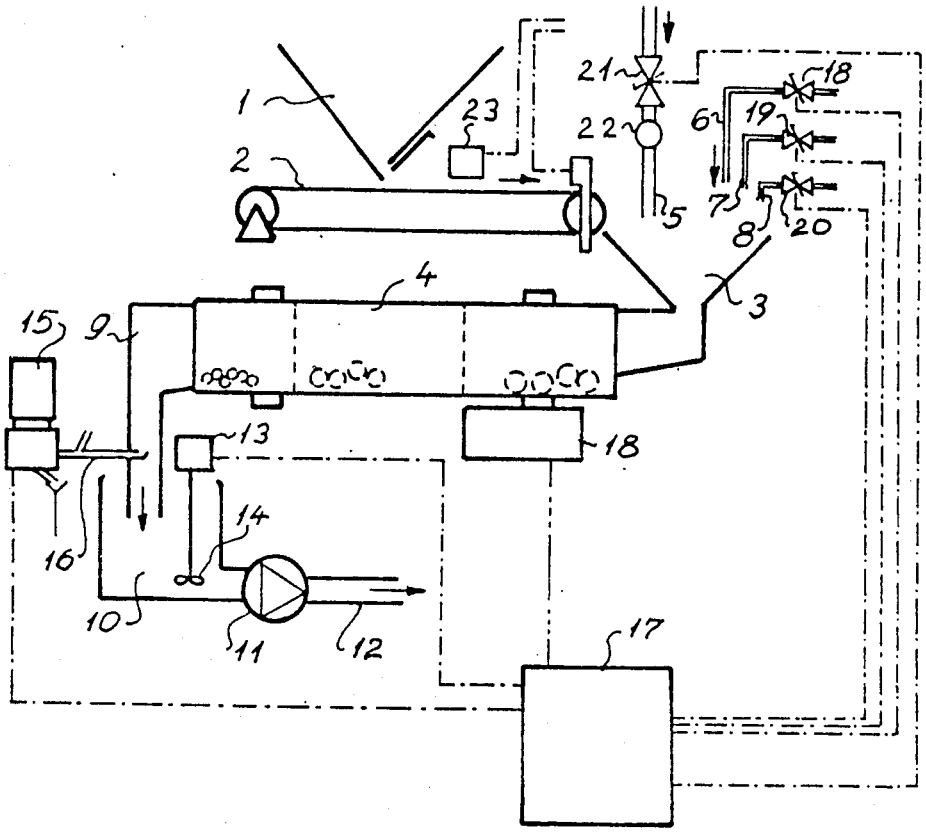
FIG. 1 shows a simplified schematic diagram of a system for preparing a suspension from different basic materials, means for examining the suspension, and means for controlling the process.

According to FIG. 1, in the system crushed coal from a feeding hopper 1 falls onto a metering conveyor type weigher 2 and is fed into the hopper 3 of a ball mill 4. A pipe 5 for water as the carrier substance is directed into the hopper 3. By pipes 6,7,8 different additives or mixtures of additives are selectively passed into the hopper 3. The ball mill 4 comprises several sections following each other and containing balls, the diameters of which decrease e.g. from 80 mm to 20 mm according to the decreasing grain size of the solid matter. The suspension formed in the ball mill 4 and composed of fine-grained solid matter, water and additives flows via a discharge 9 into a pump sump 10, and is propelled by a pump 11 into a pipeline 12. The viscosity of the suspension is determined by an appropriate measuring device 13 whereby, for example, a propeller 14, as shown, or a rotated shaft is used. The fineness of grain and the composition of grain sizes are examined by an optical monitoring system 15. At short intervals samples of the suspension flowing through the discharge 9 are taken by a sampling tube 16 and directed to the monitoring system 15 for the particle size analysis.

In the highly concentrated and fine-grained suspension according to the invention, usually no profile of the concentration is to be expected, so that a simple stationary sampling tube 16 is sufficient. Some water is added to the suspension of the sample to make it translucent, and the sample is introduced into an optical part of a particle size analyzer, in which light, for example from a laser is dispersed and reflected by the particle and is detected by an optical receiver, which sends signals to a computer 17 in which the signals are compared with index values. An apparatus "Helos 12LA" manufactured by Sympatec GmbH, 3346 Remlingen (West Germany) was used in tests and is suitable for production to analyze the particle size and the particle size distribution by on-line measurement. If in case of a deviation from the index values an adjustment with respect to the particle size or the particle size distribution becomes necessary, the computer 17 varies the drive 18 of the ball mill 4, so that the speed is changed while the flowrate remains constant. For measuring the viscosity of the suspension a viscosimeter is to be used such as "Rotovisco RV 12" made by Haake Mess-Technik GmbH in 7500 Karlsruhe (West Germany). Also the temperature of the suspension should be measured so that the signal from the viscosimeter can be amended accordingly, if necessary. A deviation from the index value of the viscosity is also controlled by the computer 17 in that by adjustable valves 18,19,20 in the pipes 6,7,8 the type and/or the amount of the additives are varied. More than three pipes with valves for the additives may be used.

A variation of the moisture content of the coarse coal fed is detected on the metering conveyor 2 by a moisture meter 23, for example by means of infrared radiometry. If the moisture content varies, the speed of the conveyor is adjusted to feed a constant amount of dry coal substance, and by a control valve 21 in the pipe 5 the amount of water is controlled and determined by a water meter 22.

With a system as shown in FIG. 1, an amount of suspension of, for example, 5 tons per hour is to be prepared and supplied continuously into the pipeline at constant feeding pressure. A constant viscosity is required for continuous supply. Further, a constant concentration of coal of e.g. 70 wgt. % having a grain size of up to 0.2 mm but ideally less than 0.1 mm with a high content of very fine particles has to be maintained. These features have to be constant so that the suspension can be used, for example, for feeding a burner.

From the hopper 1 coal having a grain size of 6 mm or, if the coal is very hard, of 4 mm runs onto the conveyor type weigher 2. Here the moisture content is determined and the speed of the conveyor is adjusted so that the continuously fed dry amount of coal remains constant. At the same time, the amount of water is adjusted according to the moisture content of the coal. The water flushes the coal into the ball mill 4. A ball mill for this example has a diameter of 1.4 m and a length of about 4.5 m. In the ball mill grinding the coal and forming of the suspension including additives such as surfactants occur in one step.

If the features of the coal vary resulting in a deviation of particle size, a deviation of the viscosity can also occur. However, an increase in the speed of the ball mill to avoid particles larger than, for example, 0.2 mm does not adjust the viscosity to the desired value. By means of an appropriate computer program the viscosity can be influenced by the valves 18,19,20 for selected additives, so that the desired value of the viscosity is also maintained independently from any influence of the particle size.

A system according to FIG. 1 including the control devices provides the possibility of preparing and supplying a highly concentrated and fine-grained suspension with constant features, particularly with respect to the content of coal, the fineness of the solid particles and the viscosity, from basic materials of varying properties.

Figure 2:
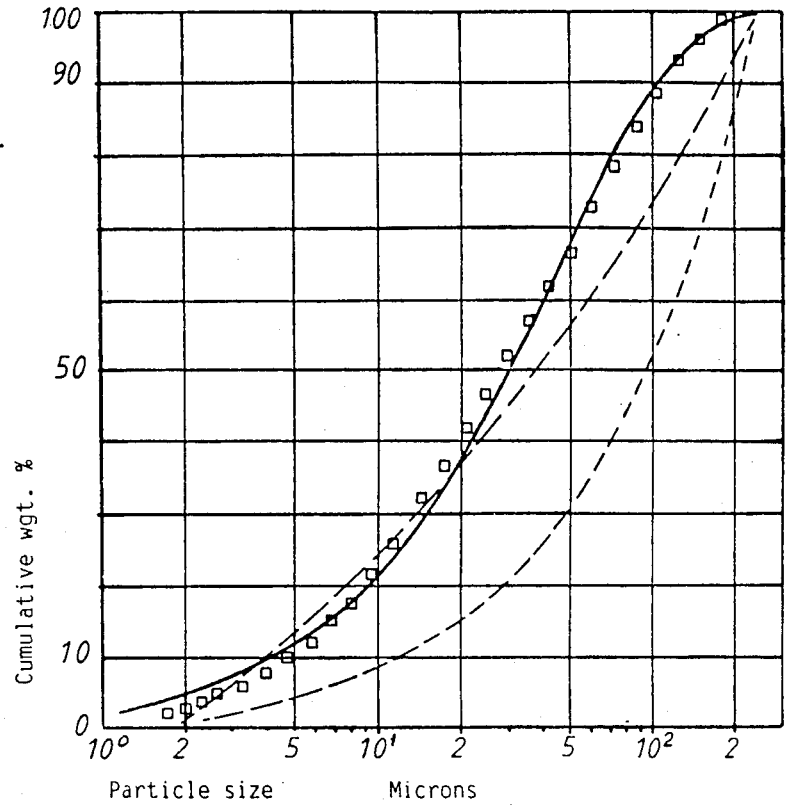
FIG. 2 is a diagram of particle size distributions and shows analyzed values in comparison with a theoretical RRSB-distribution and with curves according to the Alfred formula.

FIG. 2 is a chart showing correlations between particle size distributions by weight percent and particle sizes in microns (μm). Square points show measured values of a suspension prepared from a coal from Poland and containing 71 wgt. % of coal (dry basis). The full line is a theoretical and optimal RRSB distribution (RRSB=ROSIN, RAMMLER, SPERLING, BENNET), which follows the function $$Q = 1 - e^{-(D/D')^m}$$

with

Figure 3:
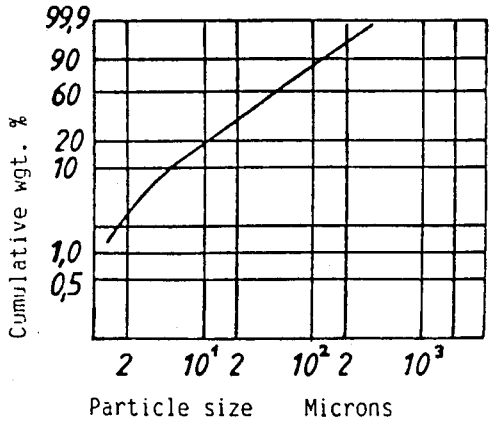
FIG. 3 is a diagram of particle size distribution as analyzed in a RRSB-grid.

Q=cumulative weight
D=largest particle size
D=mean particle size
m=inclination of a plotted line, which is a straight line in an RRSB grid (as in FIG. 3)

Further, in FIG. 2 two curves according to the Alfred formula $$CPFT = \left[ \frac{D_\mu{}^n - D_s{}^n}{D_L{}^n - D_s{}^n} \right] \cdot 100$$

are shown in dotted lines for the numerical exponents n=0.2 and n=0.7. The Alfred formula is explained in U.S. Pat. No. 4,282,006.

The analyzed suspension is very near the optimal RRSB-distribution though there are some small deviations. In any case the chart proves that a highly concentrated and fine-grained suspension having a content of solid particles of 71%, dry basis, can be prepared with a particle size almost according to a RRSB-distribution.

FIG. 3 is a logarithmical grid as used for RRSB-distributions. The plotted line represents analyzed values as FIG. 2. Except for small particle sizes the line can be regarded as a straight line.

Similar results as shown in FIGS. 2 and 3 were obtained if coal from the Ruhr (West Germany) and from Russia was ground to prepare suspensions having a content of solid matter of more than 65%. Generally the conditions of the process have to be determined depending on the quality of the solid matter, the required amount of fine solid particles and the required viscosity. After starting the process it can be continued over a long period. When the properties of the basic materials deviate from the values originally found or when wear occurs in the ball mill, the conditions and/or the composition of the additives are amended and thereby the features of the suspension maintained constant.

What is claimed is:

1. A method for the continuous production of a substantially constant efflux of a highly concentrated mineral slurry comprising a finely ground mineral material, a liquid and at least one additive, said mineral slurry having a substantially constant viscosity, a substantially constant ratio of dry weight of said mineral material to total liquid, and a minimal variance of particle size distribution of said finely ground mineral material, said efflux of mineral slurry supplying a substantially constant dry weight of said mineral material per unit of time, said method comprising the steps of:

(a) providing a first flow comprising said mineral material in a coarsely ground state and said liquid, said first flow having a substantially constant ratio of equivalent dry weight of said mineral material to total liquid, said step of providing said first flow comprising the substeps of:
  (1) providing a stream of said mineral material in said coarsely ground state;
  (2) continuously determining the moisture content of said stream of said mineral material;
  (3) providing a stream of said liquid; and
  (4) adjusting the flow rate of said stream of said liquid according to said continuously determined moisture content;
(b) providing a variable second flow of said at least one additive;
(c) combining said first and second flows and simultaneously mixing and comminuting said resulting combined flow to produce said mineral slurry;
(d) determining the viscosity of said so produced mineral slurry; and
(e) adjusting said second flow of said at least one additive to maintain said viscosity of said mineral slurry substantially constant.

2. A method for the continuous production of a substantially constant efflux of a highly concentrated mineral slurry comprising a finely ground mineral material, a liquid and at least one additive, said mineral slurry having a substantially constant viscosity, a substantially constant ratio of dry weight of said mineral material to total liquid, and a minimal variance of particle size distribution of said finely ground mineral material, said efflux of mineral slurry supplying a substantially constant dry weight of said mineral material per unit of time, said method comprising the steps of:

(a) providing a first flow comprising said mineral material in a coarsely ground state and said liquid, said first flow having a substantially constant ratio of equivalent dry weight of said mineral material to total liquid, said step of providing said first flow comprising the substeps of:
  (1) providing a stream of said mineral material in said coarsely ground state;
  (2) continuously determining the moisture content of said stream of said mineral material;
  (3) providing a stream of said liquid; and
  (4) adjusting the flow rate of said stream of said liquid according to said continuously determined moisture content;
(b) providing a variable second flow of said at least one additive;
(c) combining said first and second flows and simultaneously mixing and comminuting said resulting combined flow to produce said mineral slurry;
(d) determining the particle sizes of said so produced mineral slurry;
(e) determining the viscosity of said so produced mineral slurry;

(f) adjusting said simultaneous mixing and comminuting process to maintain said particle sizes of said mineral slurry within said desired minimal range; and (g) adjusting said second flow of said at least one additive to maintain said viscosity of said mineral slurry substantially constant.

3. A method for the continuous production of a substantially constant efflux of a highly concentrated mineral slurry comprising a finely ground mineral material, a liquid and at least one additive, said mineral slurry having a substantially constant viscosity, a substantially constant ratio of dry weight of said mineral material to total liquid, and a minimal variance of particle size distribution of said finely ground mineral material, said efflux of mineral slurry supplying a substantially constant dry weight of said mineral material per unit of time, said method comprising the steps of:

(a) providing a variable first flow of said mineral material in a coarsely ground state;

(b) continuously determining the moisture content of said first flow of said mineral material;

(c) determining the equivalent dry weight flow rate of said mineral material supplied by said first flow;

(d) adjusting said first flow of said mineral material according to said continuous moisture content determination such that the flow rate of the equivalent dry weight of said mineral material is maintained substantially constant;

(e) providing a variable second flow of said liquid;

(f) adjusting said second flow of said liquid such that the aggregrate ratio of mineral material to total liquid of said first and second flows remains substantially constant;

(g) providing a variable third flow of said at least one additive;

(h) combining said first, second and third flows of said coarsely ground mineral material, said liquid and said additive, respectively, said simultaneously mixing and comminuting said resulting combined flow to produce said mineral slurry;

(i) determining the particle sizes of said so produced mineral slurry;

(j) determining the viscosity of said so produced mineral slurry;

(k) adjusting said simultaneous mixing and comminuting process to maintain said particle sizes of said mineral slurry within said desired minimal range; and (l) adjusting said third flow of said at least one additive to maintain said viscosity of said mineral slurry substantially constant.

4. The method according to claim 3, wherein said mixing and comminuting of step (h) is effected in a singular ball mill, and wherein said adjusting of step (k) is effected by adjusting the speed of said ball mill to minimize variations in said particle size distribution of said mineral slurry.

5. The method according to claim 4, wherein a substantially constant equivalent dry weight of said mineral material in a coarsely ground state is continuously introduced into said singular ball mill per unit of time, and wherein a substantially constant amount of said so produced mineral slurry is produced by said process and is introduced into a pipeline.

6. The method according to claim 5, wherein said so produced mineral slurry contains a constant percentage of said finely ground mineral material, said constant percentage being between about 65 and about 75 percent equivalent dry weight, wherein said at least one additive comprises about two percent by weight of said finely ground mineral material, and wherein the remainder of said so produced mineral slurry comprises liquid.

7. The method according to claim 4, wherein said mineral material is said coarsely ground state comprises mineral material having grain sizes of about 6 mm and less, wherein said mixing and comminuting process produces said finely ground mineral material which has a maximum grain size of about 0.2 mm, and wherein the particle size distribution of said finely ground mineral material is substantially in accordance with an RRSB curve.

8. The method according to claim 7, wherein said mineral material comprises coal, and wherein said liquid comprises water.

* * * * *